US011781465B1

(12) United States Patent
Woods et al.

(10) Patent No.: US 11,781,465 B1
(45) Date of Patent: Oct. 10, 2023

(54) VORTEX GENERATING APPARATUS FOR USE WITH MARINE EXHAUST SYSTEMS FOR IMPROVED EXHAUST COOLING

(71) Applicants: Woodrow Woods, Riviera Beach, FL (US); Darrin Woods, Riviera Beach, FL (US)

(72) Inventors: Woodrow Woods, Riviera Beach, FL (US); Darrin Woods, Riviera Beach, FL (US)

( * ) Notice: Subject to any disclaimer, the term of this patent is extended or adjusted under 35 U.S.C. 154(b) by 147 days.

(21) Appl. No.: 17/145,619

(22) Filed: Jan. 11, 2021

Related U.S. Application Data

(63) Continuation of application No. 16/801,601, filed on Feb. 26, 2020, now Pat. No. 10,890,094, which is a continuation of application No. 15/959,474, filed on Apr. 23, 2018, now Pat. No. 10,584,625.

(60) Provisional application No. 62/490,737, filed on Apr. 27, 2017.

(51) Int. Cl.
*F01N 13/00* (2010.01)
*F01N 13/08* (2010.01)
*F01N 3/04* (2006.01)

(52) U.S. Cl.
CPC ..... *F01N 13/004* (2013.01); *F01N 3/046* (2013.01); *F01N 13/082* (2013.01); *F01N 2590/02* (2013.01)

(58) Field of Classification Search
CPC .... F01N 13/004; F01N 3/046; F01N 2590/02; F01N 13/082
See application file for complete search history.

(56) References Cited

U.S. PATENT DOCUMENTS

| | | | | |
|---|---|---|---|---|
| 4,306,867 | A * | 12/1981 | Finze | B63H 20/245 440/49 |
| 5,740,670 | A * | 4/1998 | Woods | F01N 3/046 440/89 C |
| 6,035,633 | A * | 3/2000 | Woods | B63H 21/32 440/89 C |
| 7,160,161 | B2 * | 1/2007 | Abdel-Maksoud | B63H 21/32 440/89 B |
| 8,651,907 | B2 * | 2/2014 | Woods | F01N 3/04 440/89 C |
| 9,334,036 | B1 * | 5/2016 | Woods | F01N 3/04 |
| 9,731,805 | B1 * | 8/2017 | Woods | F01N 3/04 |
| 2005/0215133 | A1 * | 9/2005 | Abdel-Maksoud | B63G 13/00 440/89 R |
| 2008/0141921 | A1 * | 6/2008 | Hinderks | F02B 59/00 114/274 |
| 2012/0227389 | A1 * | 9/2012 | Hinderks | F01L 3/02 60/317 |

* cited by examiner

*Primary Examiner* — S. Joseph Morano
*Assistant Examiner* — Jovon E Hayes
(74) *Attorney, Agent, or Firm* — Mark D. Bowen, Esq.; Malin Haley DiMaggio & Bowen, P.A.

(57) ABSTRACT

A vortex generating exhaust component is installed in-line within a marine exhaust system downstream of the water can whereby a mixture of hot exhaust gas and entrained cooling water flows there through and vortex flow is enhanced by the component to increase cooling of exhaust gas by increasing the mixing of hot exhaust gas with entrained cooling water thereby resulting in enhanced exhaust gas cooling.

2 Claims, 9 Drawing Sheets

VORTEX GENERATING APPARATUS FOR USE WITH MARINE EXHAUST SYSTEMS FOR IMPROVED EXHAUST COOLING

CROSS REFERENCE TO RELATED APPLICATIONS

This application is a continuation of U.S. patent application Ser. No. 16/801,601, filed on Feb. 26, 2020, which is a continuation of U.S. patent application Ser. No. 15/959,474, filed on Apr. 23, 2018, now U.S. Pat. No. 10,584,625, which claims the benefit of provisional U.S. Patent Application Ser. No. 62/490,737, filed on Apr. 27, 2017.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to marine exhaust systems for use with internal combustion marine engines, and more particularly to a vortex generating apparatus which acts on marine exhaust and entrained cooling water flowing within an exhaust system to enhance cooling of the exhaust.

2. Description of Related Art

Internal combustion marine engines are cooled by water which is drawn from the body of water in which the vessel is operating (e.g. ocean, lake, etc.). After cooling the engine, a portion of the cooling water is typically sprayed into the exhaust gas stream via a water jacketed exhaust component (a/k/a water can) to cool the engine exhaust. Preferably, the exhaust is cooled as far upstream as possible to reduce thermal stress on, and overheating of, the downstream exhaust system components.

FIGS. 1-3 depict examples of prior art marine exhaust system water cans. The typical arrangement employs a water jacketed exhaust component 2 having an exhaust pipe 4, a water jacket 6 disposed in surrounding relation with exhaust pipe 4, and a spray ring 8. The water jacketed exhaust component is typically mounted downstream of the turbocharger and receives exhaust gas and cooling water from the marine engine. Exhaust gas, referenced "E", flows through exhaust pipe 4, and cooling water, referenced "W", flows through the volume 5 between the outer surface of the exhaust pipe 4 and the inner surface of the water jacket 6 and is ejected via apertures 9 in spray ring 8. Generally, the spray ring 8 contains a plurality of apertures 9 from which the cooling water is ejected under pressure from the water pump in the form of a spray or stream.

The prior art water jacketed exhaust component shown in FIG. 1 was burdened by a number of significant problems and is not in widespread use. First, the water stream exiting the spray ring tended to flow along the outer circumference of the volume of exhaust gas flow as shown in FIG. 1. That spray pattern resulted in a poor mixture of cooling water and exhaust gas and thus poor heat exchange/exhaust cooling. As a result, the exhaust system components downstream of the tail end of the water jacketed exhaust component 2 were subjected to excessive exhaust gas temperatures. An additional shortcoming present with the prior art water jacketed exhaust component shown in FIG. 1, was corrosion. Specifically, the present inventor determined that narrow band of boundary layer turbulent flow along the inner surface of the exhaust pipe 4 created counter flow that caused cooling water to migrate upstream, i.e. opposite the direction of exhaust gas flow. As a result of this upstream migration of cooling water (typically saltwater) exhaust gas chemicals such as hydrogen-sulfide and carbon were chemically reacting with the chloride ions produced from the heated saltwater to form acid, including sulfuric acid which became deposited on the inner surface of exhaust pipe 4. Over time, this acid corroded the water jacketed exhaust component. Accordingly, there existed a need for an improved water jacketed exhaust pipe that provided a superior mixture of cooling water and exhaust gas, while preventing the upstream migration of cooling water.

In response to those problems in the art, the present inventor provided significant advancements in the art of marine water jacketed exhaust components as shown in FIGS. 2 and 3. In U.S. Pat. Nos. 5,740,670 and 6,035,633, the disclosures of which are incorporated herein by reference, the present inventor disclosed water jacketed exhaust components wherein the tail end of the exhaust pipe (inner liner) was inwardly tapered to clip the turbulence that occurs along the inner walls so that cooling water would not migrate upstream thereby significantly reducing corrosion of the exhaust pipe. In addition, the tail end of the water jacket (outer shell) was inwardly tapered to direct and deflect cooling water into the exhaust gas stream thereby improving heat transfer between the hot exhaust gas and the cooling water. Finally, a backward inclined or angled spray ring 8 was disclosed whereby cooling water could be directed toward the outer shell such whereby a portion of the water would be deflected back toward the outer surface of the exhaust pipe, while the remaining portion flowed along the inner surface of the outer shell. The redirected water particles are easily vaporized and in the process extract a significant amount of heat from the exhaust gases. In addition, the prior art reveals water cans having forward inclined spray rings for directing water downstream and radially inward.

The present inventor has also been awarded U.S. Pat. Nos. 9,731,805; 9,334,036 and 8,651,907, the disclosures of which are incorporated herein by reference, wherein improved V-shaped spray ring technology is disclosed which further enhances exhaust gas cooling over wide engine RPM operating ranges. Water jacketed exhaust components incorporating the many advancements developed by the present inventor and disclosed in the patents cited above have met with widespread success and use in the marine industry and are believed to represent the current state of the art.

Marine engine and exhaust pipe configurations and routing vary greatly. In addition, marine engines operate over a wide power range, e.g. from idle (low RPM) to full throttle (high RPM), and the respective volume flow of cooling water and exhaust gas produced by a marine engine generally varies in direct proportion to throttle setting, with minimal volume flow of cooling water and exhaust gas at idle, and a maximum volume flow at full throttle. These variations in operating conditions, along with endless possible exhaust pipe routing configurations present the exhaust system designer with challenges in designing an exhaust system that is capable of sufficiently cooling the exhaust gas to prevent overheating of downstream exhaust components. As a result, certain marine exhaust system configurations still experience excessive exhaust gas temperatures downstream of the water can. Accordingly, there exists a need for advancements in the field of marine exhaust systems directed to maximizing exhaust cooling.

BRIEF SUMMARY OF THE INVENTION

The present invention overcomes the limitations and disadvantages in the art by providing a vortex generating marine exhaust component for installation within exhaust pipe, preferably downstream from the water can, which enhances cooling of exhaust gas by creation of turbulent exhaust gas flow that significantly enhances the mixing of hot exhaust gas with entrained cooling water. A vortex generating component in accordance with the present invention preferably comprises an annular structure installed in the exhaust duct system downstream of the water can. A plurality of circumferentially disposed vortex generating tabs project from the annular structure in a radially inward and downstream orientation. The tabs are angularly spaced thereby defining gaps therebetween. The vortex generating component induces a whirling vortex-type flow in the exhaust gas and entrained cooling water flowing therethrough, whereby the turbulent flow has been found to significantly improve the mixing of exhaust gas with entrained cooling water resulting in improved exhaust gas cooling. In an alternate embodiment, the vortex generating component may be integrally formed at the downstream end of a water can of the type discussed herein above.

Accordingly, it is an object of the present invention to provide enhanced cooling of exhaust gas generated by marine engines.

Another object of the present invention is to provide a vortex generating component within a marine exhaust system to maximize exhaust gas cooling by enhanced mixing of exhaust gas and cooling water through the generation of whirling vortex flow.

These and other objects are met by the present invention which will become more apparent from the accompanying drawing and the following detailed description of the drawings and preferred embodiments.

DETAILED DESCRIPTION OF THE INVENTION

With reference to the drawings, FIGS. 4A-10 depict a vortex generating marine exhaust component, generally referenced as 10, for installation downstream from a water can of the type known in the prior art as discussed above. In a preferred embodiment, vortex generating exhaust component 10 is installed in a marine exhaust piping system downstream of the water can whereby a mixture of hot exhaust gas and entrained cooling water flows through vortex component 10. Vortex generator 10 enhances cooling of exhaust gas by creation or enhancement of whirling/turbulent exhaust gas flow that significantly enhances the mixing of hot exhaust gas with entrained cooling water thereby cooling the exhaust gas to a greater degree than would be realized in an identical system not adapted with component 10.

Figure 1:
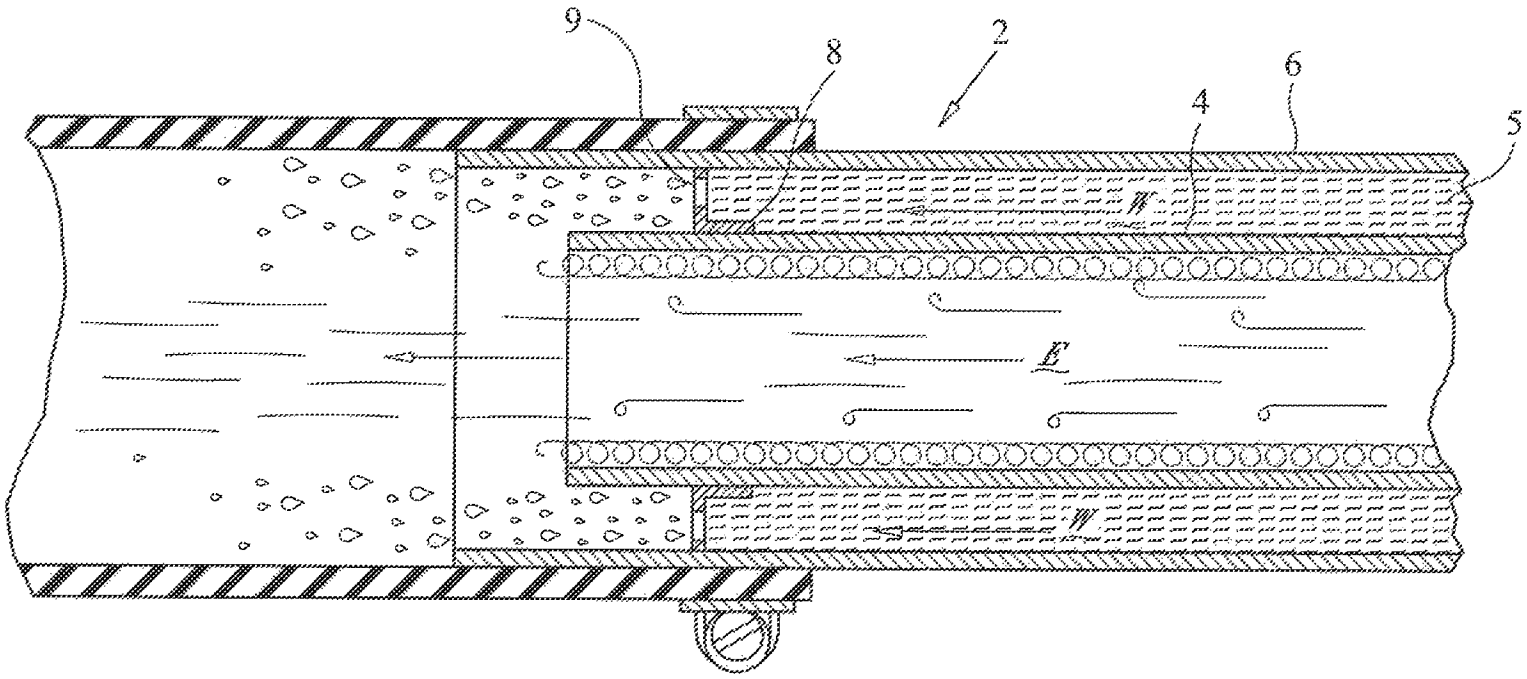
FIG. 1 (PRIOR ART)
FIG. 1 is a side sectional view of water jacketed marine exhaust component in accordance with the prior art.
Figure 2:
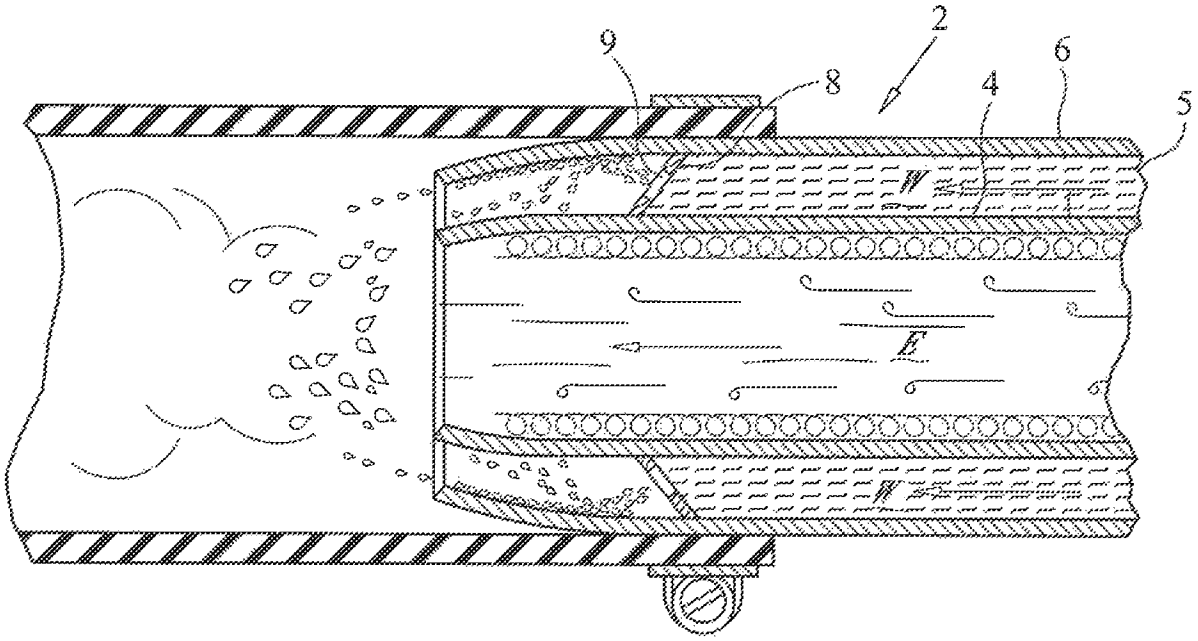
FIG. 2 (PRIOR ART)
FIG. 2 is a side sectional view of an alternate embodiment water jacketed marine exhaust component in accordance with the prior art.
Figure 3:
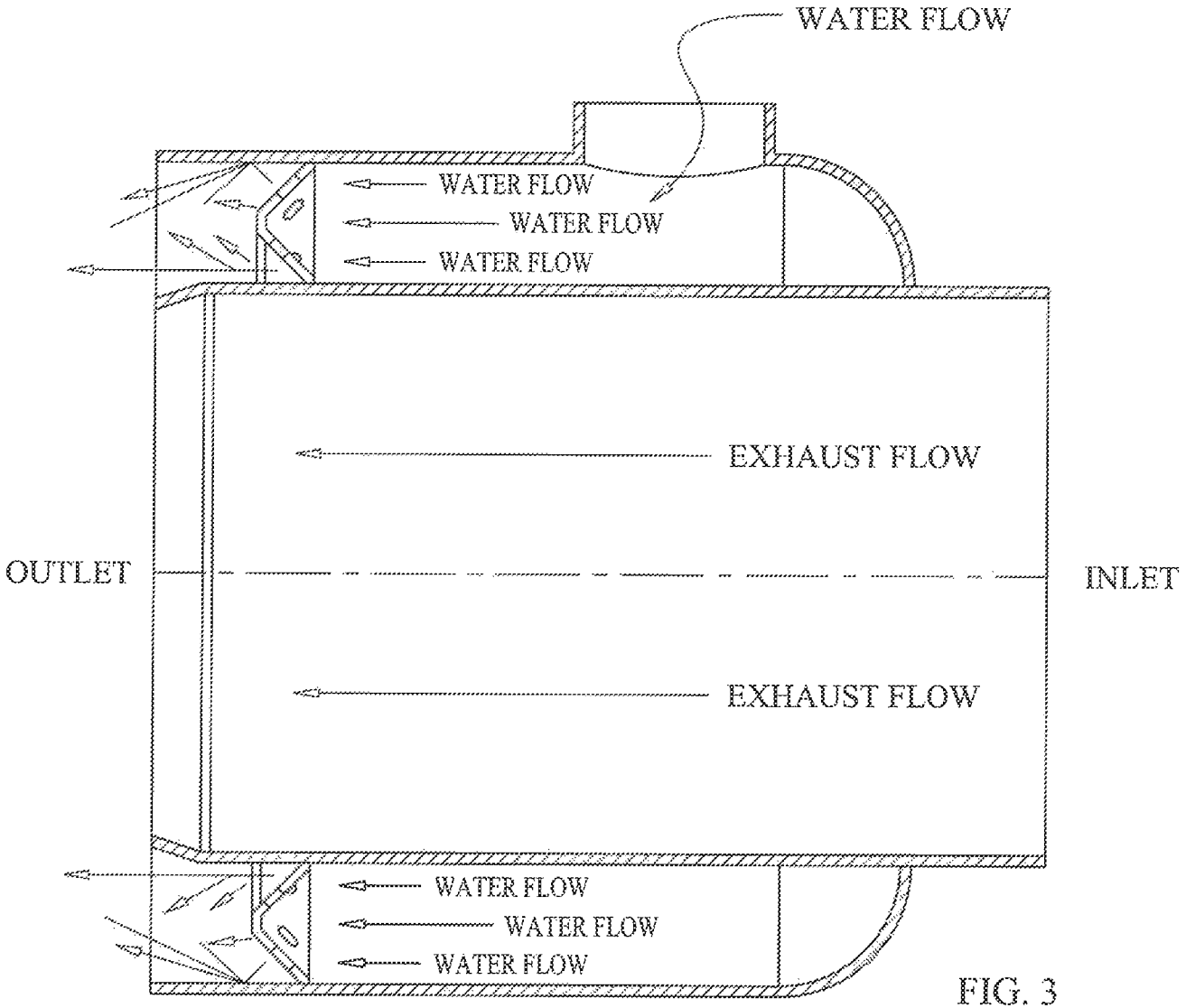
FIG. 3 (PRIOR ART)
FIG. 3 is yet another side sectional view of an alternate embodiment water jacketed marine exhaust component in accordance with the prior art.
Figure 4A:
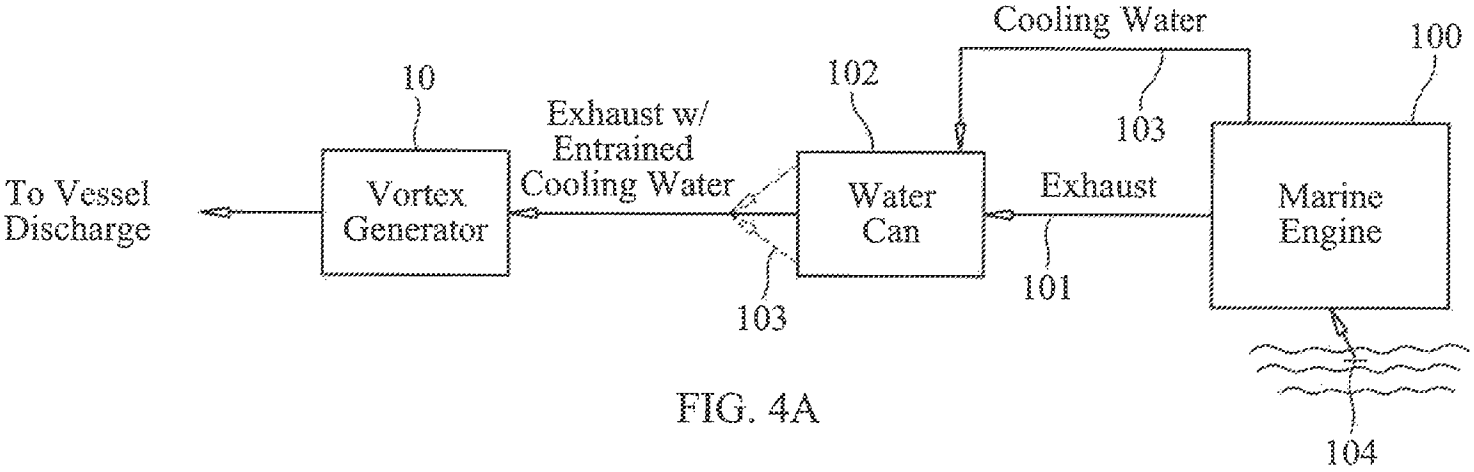
FIG. 4A is a schematic block diagram showing a vortex generating component in accordance with the present invention shown in spaced downstream relation with a water can.
Figure 4B:
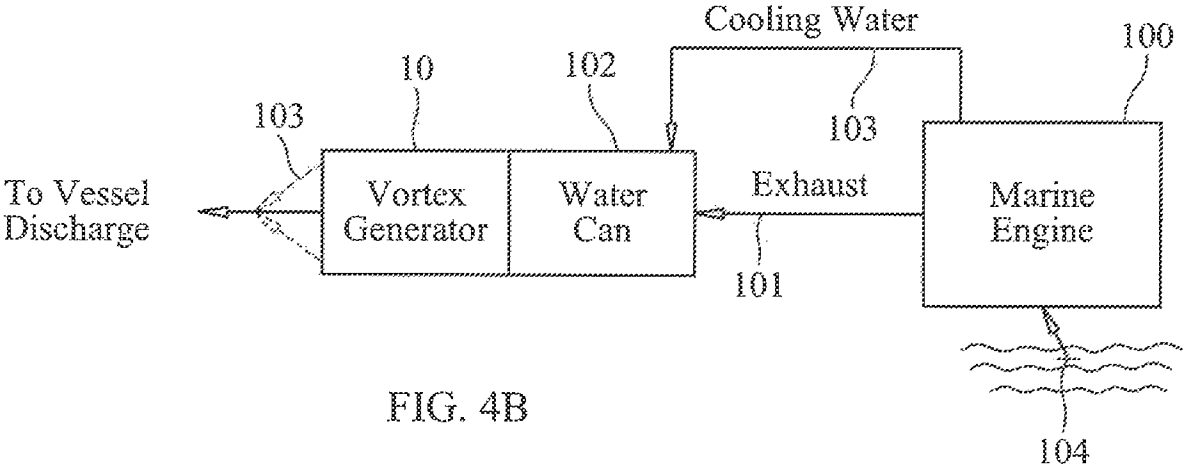
FIG. 4B is a schematic block diagram showing a vortex generating component in accordance with the present invention shown integrated with the downstream end of a water can.
Figure 5:
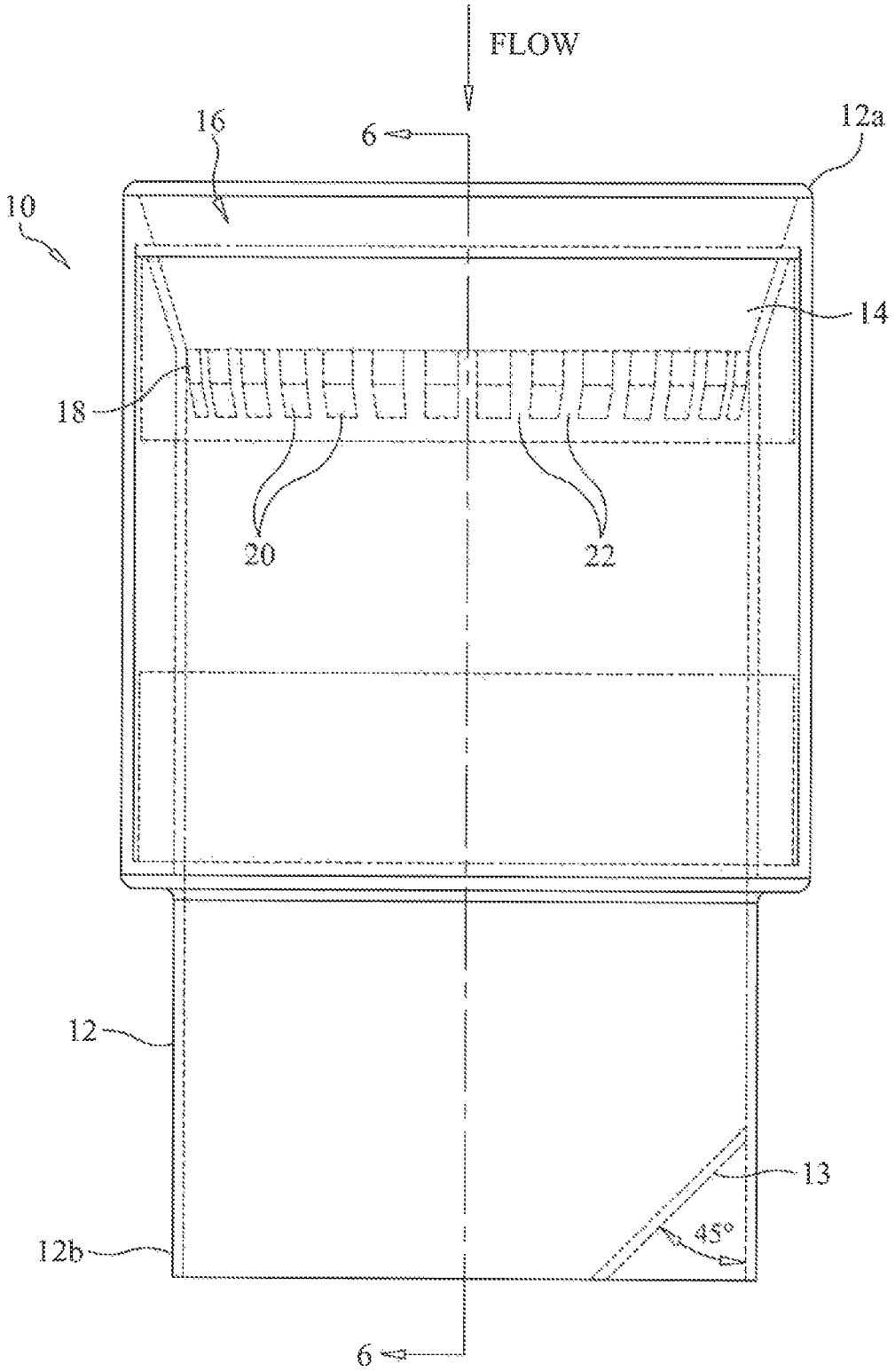
FIG. 5 illustrates a vortex generating marine exhaust component in accordance with the present invention.

FIGS. 4A and 4B provide schematic illustrations depicting alternate installation applications for vortex component 10. In a preferred embodiment, vortex generator 10 is installed in marine exhaust piping in downstream spaced relation with the water can as illustrated in FIG. 4A. In an alternate embodiment, however, the vortex generator may be integral with exhaust pipe at the discharge end of the water can as illustrated in FIG. 4B. Accordingly, as used herein the term "vortex generating exhaust component" or "vortex generator" and similar variations thereof shall broadly be construed to mean the inclusion of vortex generating structure either within a section of exhaust pipe or duct, or alternatively the adaptation of said structure to the outlet end of a marine water can.

Figure 9:
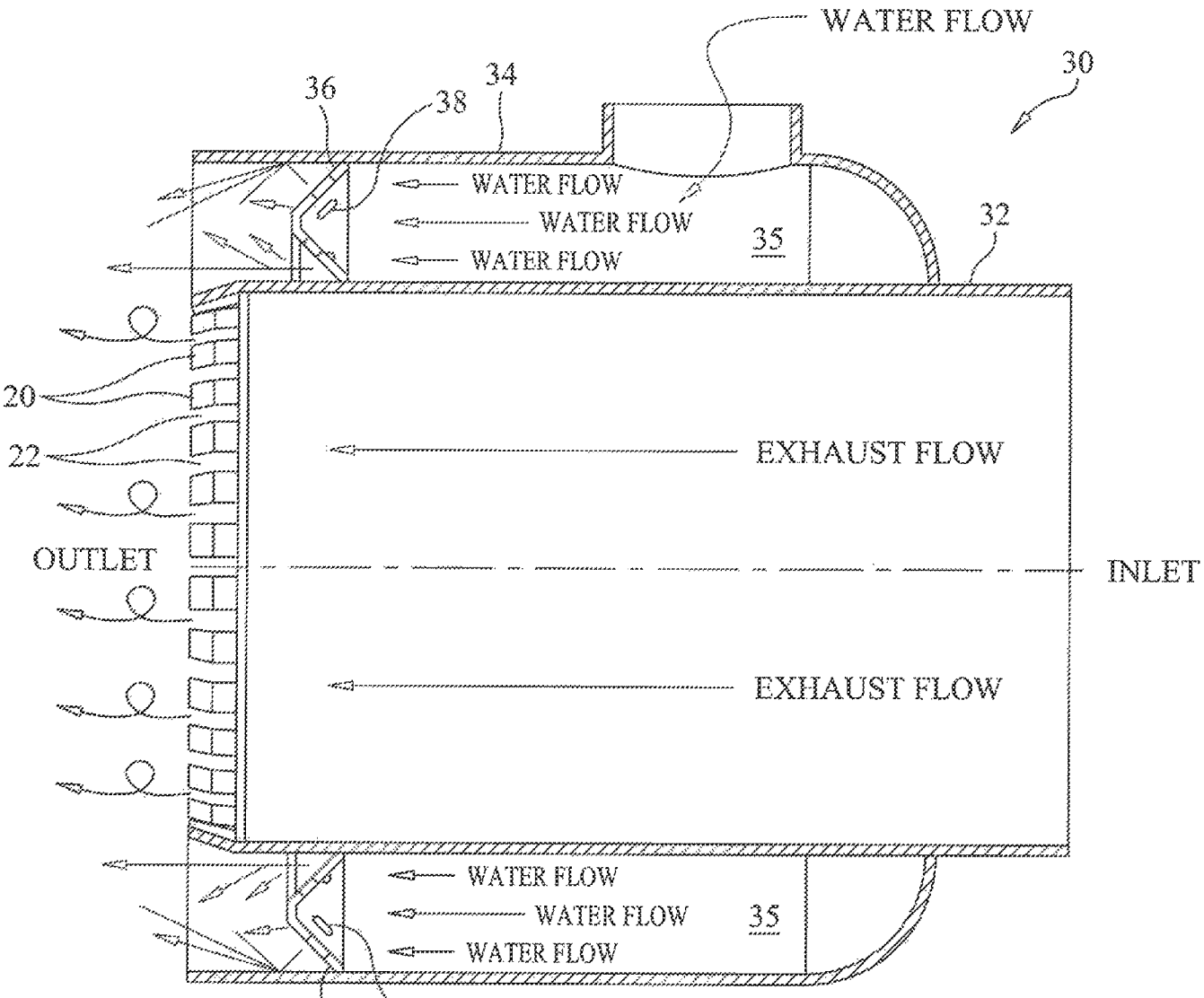
FIG. 9 is an alternate embodiment water can having an outlet adapted with vortex generating structure in accordance with the present invention.

In the preferred embodiment depicted in FIG. 4A, a marine engine 100 discharges hot exhaust gas 101 into a water can 102. In addition, marine engine 100 discharges cooling water 103, which has circulated through the engine after having been drawn from the body of water (e.g. ocean) through a cooling water inlet 104 upon which the vessel travels. Cooling water 103 is injected into water can 102 as is known in the art as discussed above. Cooling water 103 is injected into the hot exhaust gas 101 by water can 102 and a portion thereof is flashes to steam, while the remainder thereof is entrained with the rapidly flowing exhaust gas. The exhaust gas and entrained cooling water pass through vortex component 10 whereby whirling flow is generated to induce mixing and evaporation of entrained cooling water with the exhaust gas. The flow eventually is routed to a vessel discharge location whereby the flow is discharged from the vessel. In the alternate embodiment depicted in FIG. 4B, vortex generator 10 is illustrated as being integrally associated with water can 102, namely the discharge end of the exhaust pipe being modified with the vortex generating technology as disclosed herein. FIG. 9 illustrates the embodiment schematically shown in FIG. 4B.

Turning now to FIGS. 5-8, vortex generating exhaust component 10 will now be described in an embodiment wherein the component is included in a section of exhaust pipe as schematically illustrated in FIG. 4A. Vortex generating exhaust component 10 includes tubular exhaust duct 12 which is generally fabricated from temperature resistant materials, such as fiberglass, in accordance with known practices in the art. Exhaust duct 12 has an inlet 12*a* and an outlet 12*b*. Exhaust duct 12 includes a truncated conical vortex generator 14 disposed therein, which includes an inlet end and an outlet end, which are generally referenced as 16 and 18 respectively.

Figure 7:
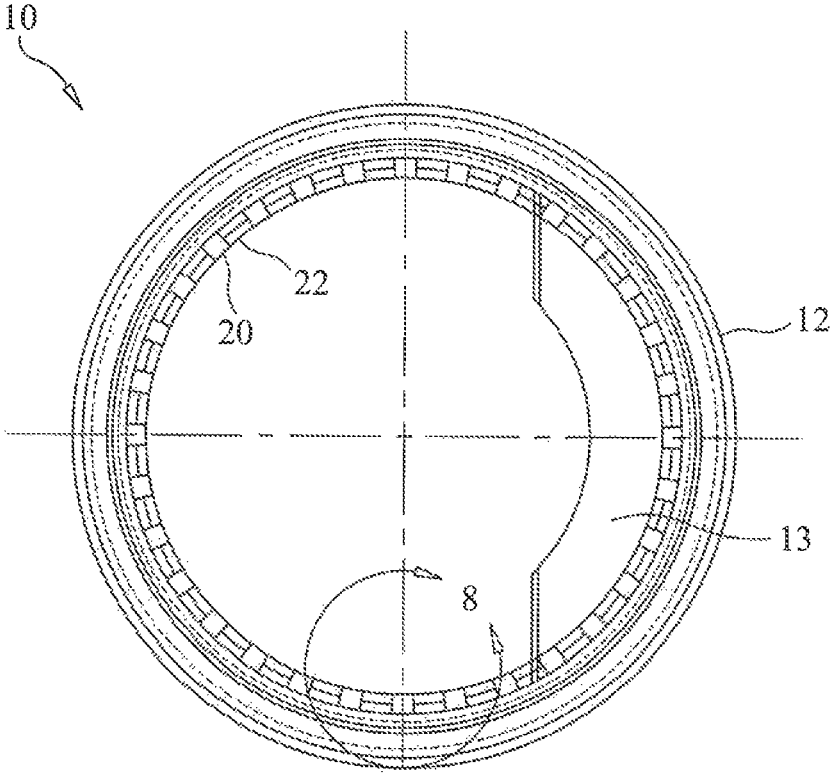
FIG. 7 is an end view thereof.
Figure 8:
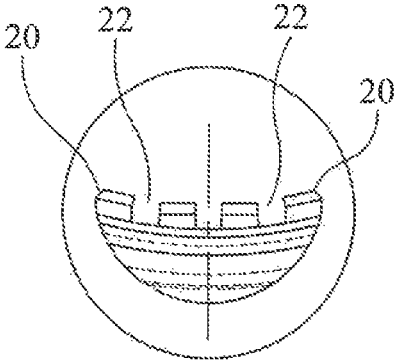
FIG. 8 is a partial detail of the area circled and identified as 8 in FIG. 6.

Vortex generator 14 comprises an annular structure which is concentrically disposed within, or otherwise connected to, exhaust duct 12. In a preferred embodiment, inlet end 16 defines a diameter which is greater than the diameter of outlet end 18 so as to increase the velocity of the exhaust gas as it flows through vortex generator 14. A plurality of circumferentially disposed and angularly spaced vortex generating tabs 20 project from the outlet end 18 thereof. Tabs 20 are angularly spaced thereby defining gaps 22 therebetween. Tabs 20 project in a radially inward and downstream orientation to form bluff bodies that interact with exhaust gas flow to generate turbulent vortex flow downstream of the tabs. In a preferred embodiment, wherein exhaust duct 12 has an inlet of 14" and an outlet of 12", tabs 20 are sized with a length of approximately ¾" and a width or approximately ½" and are disposed with a gap spacing of approximately ½". In addition, tabs 20 are angled radially inwardly between approximately 20-40 degrees. As should be apparent, however, any suitable tab configuration, sizing, and spacing is considered within the scope of the present invention. Further, the radially inward angle may be varied for different applications. In addition, it is important that the tabs are disposed such that the side edges thereof are squared with the direction of flow (e.g. not pitched about a longitudinal tab axis relative to the direction of flow) to avoid creating a spiral flow within the downstream exhaust conduit which can result in undesired centrifugal separation of entrained water from the exhaust gas. In applications wherein the terminal end 12*b* of exhaust duct 12 is connected to an elbow (not shown) it may be desirable to include a deflecting baffle 13, suitably angled so as to deflect the flow in the desired direction. FIG. 7 is an end view depiction further illustrating deflecting baffle 13. FIG. 8 is a partial detailed view illustrating tabs 20 and gaps 22.

Figure 6:
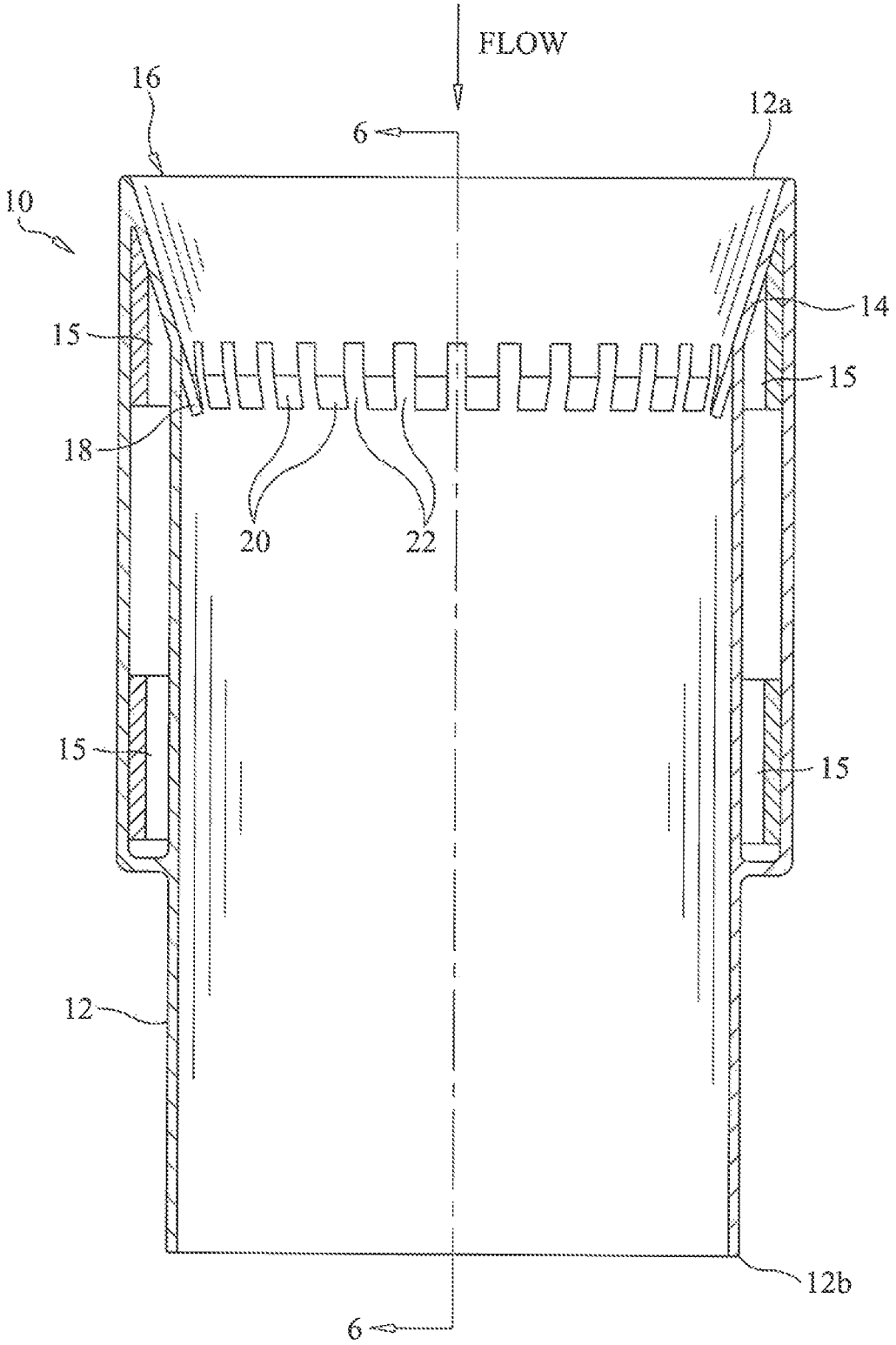
FIG. 6 is a sectional view thereof taken along line 6-6 in FIG. 5.

FIG. 6 depicts a cross-sectional illustration of vortex generating exhaust component 10 fabricated from temperature resistant fiberglass. Vortex generating exhaust component 10 includes tubular exhaust duct 12 having an inlet 12*a* and an outlet 12*b*. Exhaust duct 12 includes a truncated conical vortex generator 14 disposed therein, which includes an inlet end 16 and an outlet end 18. Tabs 20 are depicted projecting downstream and radially inward. In addition, vortex generator 14 is shown as reducing in diameter from the inlet 16 to the outlet 18. Vortex generator 14 may be integrated into exhaust duct 12 by forming the duct with a double wall structure as seen in FIG. 6. Reinforcing crush resistant rings 15 are disposed within the double wall structure to prevent installation pipe clamp rings from crushing the fiberglass outer wall upon installation.

Turbulence and vortex flow is induced in exhaust gas and entrained cooling water flowing through the vortex generator 14 thereby enhancing mixing of water and gas which results in increased water to vapor phase change (i.e. vaporization/evaporation) thereby causing the absorption of heat from the hot exhaust gas in accordance with the principals of thermodynamics. It has been found that the addition of a vortex generating exhaust component in accordance with the present invention in one application, achieved a significant exhaust gas temperature decrease of 40-50 degrees Fahrenheit, as compared to measurements obtained on said system when not adapted with the vortex generating technology disclosed herein. Accordingly, the vortex generating component induces a vortex-type whirling turbulent flow in the exhaust gas and entrained cooling water flowing therethrough which has been found to significantly enhance exhaust gas cooling.

FIG. 9 is a side sectional view of a water can, generally referenced as 30, adapted with vortex generating technology in accordance with the present invention. Water can 30 comprises a water jacketed exhaust component having an exhaust pipe 32, a water jacket 34 disposed in surrounding relation with exhaust pipe 32, and a spray ring 36. The water jacketed exhaust component is typically mounted downstream of the turbocharger and receives exhaust gas and cooling water from the marine engine. Exhaust gas flows through exhaust pipe 32, and cooling water flows through the volume 35 between the outer surface of the exhaust pipe 32 and the inner surface of the water jacket 34. The water is ejected via apertures 38 in spray ring 36. Generally, the spray ring 36 contains a plurality of apertures 38 from which the cooling water is ejected under pressure from the water pump in the form of a spray or stream. A significant aspect of the present invention involves adapting water can 30, and particularly the terminal end of exhaust pipe 32, with a plurality of vortex generating tabs 20 which are angularly spaced so as to define gaps 22. As with the embodiments discussed hereinabove, tabs 20 are angled radially inward so as to interfere with the exhaust flow thereby generating whirling vortex flow to enhance mixing of exhaust gas and cooling water in accordance with object of the present invention.

Figure 10:
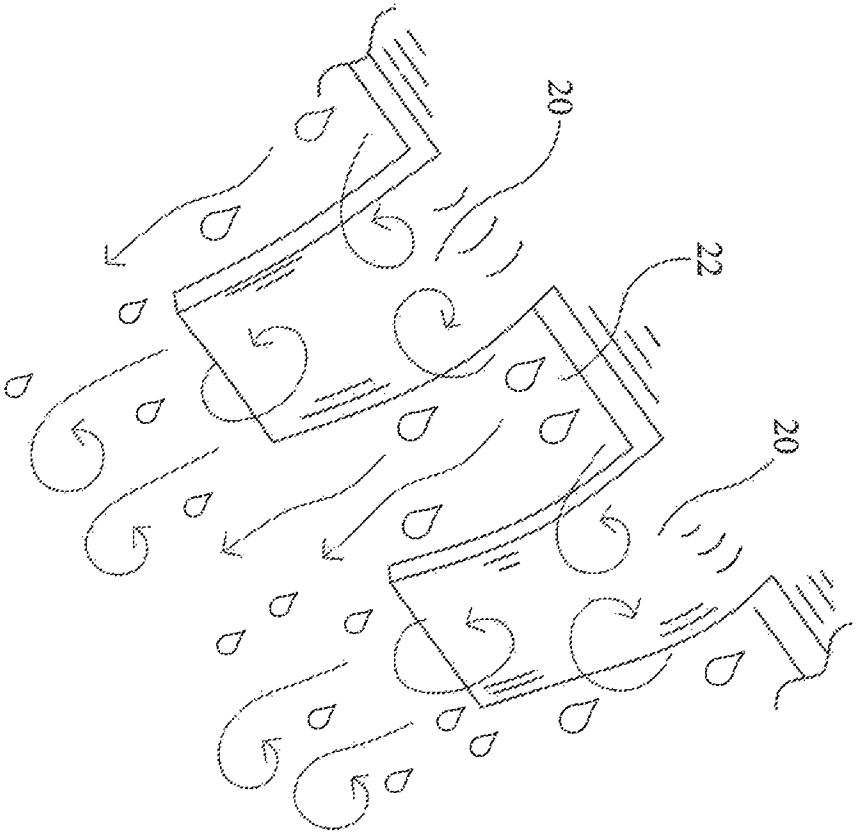
FIG. 10 is a partial detailed view illustrating vortex flow generated by the vortex generating tabs.

FIG. 10 is a partial detailed view illustrating vortex flow generated as exhaust gas and entrained cooling water flow past and through vortex generating tabs 20 and gaps 22. As illustrated in FIG. 10 exhaust gas flowing past tabs 20 is induced into a whirling chaotic disruptive flow that has been found to enhance the mixing and absorption of cooling water entrained by the exhaust gas flow. Tabs 20 have upstream facing surfaces that are preferably generally planar, but may further be concave or convex. In addition, the upstream facing surfaces are preferably disposed at a zero-degree pitch about a longitudinal axis so as to avoid imparting an axially spiral flow within the downstream exhaust pipe which could result in centrifugal separation of entrained cooling water from the exhaust gas.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method for enhancing exhaust gas cooling in a marine exhaust system having exhaust pipe defining an interior volume through which exhaust and entrained cooling water flow, said method for enhancing exhaust gas cooling comprising:

inducing vortex flow in the exhaust gas using at least one bluff body disposed within the interior volume of the exhaust pipe, wherein said bluff body comprises a tab;

whereby vortex flow enhances interaction between the exhaust gas and entrained cooling water to increase exhaust gas cooling.

2. A method of cooling marine exhaust gas carrying entrained cooling water through exhaust pipe, said method comprising:

inserting in the exhaust pipe a structure including at least one tab;

said tab inducing vortex flow in the exhaust gas, thereby enhancing mixing of water and exhaust gas resulting in increased exhaust gas cooling.

* * * * *